United States Patent [19]

Tomek

[11] Patent Number: 4,660,912

[45] Date of Patent: Apr. 28, 1987

[54] PROTECTIVE COVER FOR ELECTRICAL OUTLET

[76] Inventor: Lawrence S. Tomek, 1305 Kirkwood #107, Fort Collins, Colo. 80525

[21] Appl. No.: 830,218

[22] Filed: Feb. 18, 1986

[51] Int. Cl.[4] ..... H01R 13/44

[52] U.S. Cl. ..... 339/44 R; 174/67; 339/36

[58] Field of Search ..... 174/67; 339/36, 40, 339/43, 44 R

[56] References Cited

U.S. PATENT DOCUMENTS

| | | | |
|---|---|---|---|
| 4,070,078 | 1/1978 | Chrones | 339/44 R |
| 4,134,516 | 1/1979 | Sullo | 174/67 |
| 4,159,858 | 7/1979 | Toraya | 339/36 |
| 4,228,317 | 10/1980 | Cziment | 339/44 R |
| 4,250,349 | 2/1981 | Bennett | 339/44 R |
| 4,302,624 | 11/1981 | Newman | 339/36 |
| 4,484,021 | 11/1984 | Schaefer et al. | 174/67 |
| 4,505,403 | 3/1985 | Bowden, Jr. et al. | 339/44 M |

*Primary Examiner*—Gil Weidenfeld
*Assistant Examiner*—Paula A. Austin
*Attorney, Agent, or Firm*—John E. Reilly

[57] ABSTRACT

A protective cover for an electrical outlet is made up of a cover plate attachable to the existing receptacle plate and includes an opening aligned over each outlet in the plate and a unitary cap which is hinged to the cover along one side of each opening. The cap is movable into snap-fit engagement with a catch so as to serve as a protective cover over the outlet to prevent tampering and protect it from the elements. A latch release mechanism internally of the cap minimizes the risk of opening by infants as well as making it weatherproof.

12 Claims, 6 Drawing Figures

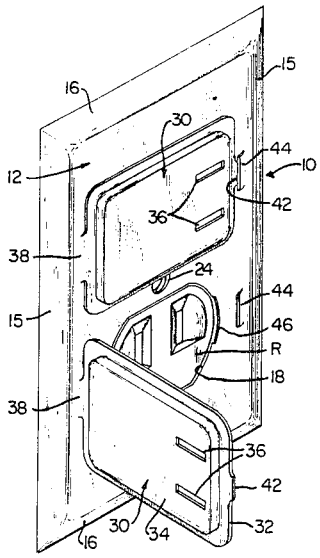

PROTECTIVE COVER FOR ELECTRICAL OUTLET

SPECIFICATION

This invention relates to electrical outlets whether of the indoor or outdoor type and more particularly to a novel and improved protective covering for outlets and the like which is both effectively weatherproof and tamper-proof.

BACKGROUND AND FIELD OF THE INVENTION

Protective coverings have been devised in the past for electrical outlets either to the end of making the outlets weatherproof or of minimizing possible hazards to infants occasioned by inserting metal objects into the sockets when the prongs of an electrical plug are not in place. Typically, protective coverings which are presently available can be hinged to one side of an opening which surrounds the socket portion and spring-loaded into a closed position over the opening when the socket is not in use. For some reason, sockets are fascinating to many youngsters who will attempt to insert metal objects into the socket, such as, nails or coins and can result in serious electrical shock and injury to the child.

Even the use of spring-loaded closures does not serve as an effective deterent to many youngsters who are able to pry open the closure to expose the socket. In an effort to overcome this problem, releasable closures have been devised which will more positively lock in a closed position to minimize the possibility of a child prying the closure away from the closed position. For example, U.S. Letters Pat. No. 3,198,373 to Ramsing employs a protective cover which has a snap-fit arrangement between the free end of the cover and a catch at the base of the cover to establish sealed engagement between the cover plate and outlet surface. U.S. Pat. No. 3,716,815 to Riches discloses a protective covering which is movable into snap-fit engagement with an upstanding rim around the socket portion and which requires a tool insertable into openings in the closure to effectively pry the closure away from the outlet. Again, Riches is designed with a special form of upstanding socket portion and in the closed position does not form any type of barrier or interruption between the tool-receiving openings in the cap and the socket portions.

In U.S. Pat. No. 4,455,101 to Davis an opening force must be applied to overcome the spring-loading of a protective cover in order to expose the socket. Other patents of interest in this field are those to Munoz, Kolster, Chrones, Sullo, Bennett,Chesnut, Schaefer, and Bowden.

It is a desirable feature and aim of the present invention to provide a protective covering conformable for use with various types of standard electrical outlets having flush mounted electrical sockets and which achieves positive snap-fitting engagement and requires a positive release action to disengage the cap and expose the outlet for use and in such a way as to effectively prevent opening by youngsters.

SUMMARY OF INVENTION

It is therefore an object of the present invention to provide for a novel and improved protective covering for electrical outlets which is both weatherproof and tamper-proof.

Another object is to provide for a unitary protective covering for electrical outlets which is rugged, high strength and of durable construction and can be easily attached and detached to and from existing electrical outlets.

It is a further object of the present invention to provide for a protective covering for electrical outlets which is conformable for use with different sizes and types of electrical outlets and can be constructed for use with single or multiple outlet fixtures.

It is an additional object of the present invention to provide for a novel and improved protective covering for electrical outlets having a cap serving as a releasable closure over the socket portion of the outlets to prevent tampering and possible electrical shock or hazard to infants.

In accordance with the present invention there has been devised a protective cover or closure which is comprised of a cover plate having an exterior surface and an interior surface with an opening through the plate and means for releasably connecting the cover plate to another surface such that the opening is positioned over an element to be covered but where access is periodically required. A catch is positioned on the exterior surface of the plate alongside the opening, and a generally convex cap member includes means which hinge the cap to the plate on one side of the plate opposite to the catch for movement between an open position and a closed position, the cap being sized to substantially cover the opening and the item to be covered when in the closed position and provided with latching means which are movable into snap-fit engagement with the catch when the cap is in the closed position. A release lever extends from one end of the cap adjacent to the latching means across the interior of the cap and beneath the opening, and release means is insertable through the opening in the cap to depress the release lever in a direction exerting an upward pressure on the latching means to release it from engagement with the catch and to permit movement of the cap member to the open position.

The present invention is best exemplified by its use in forming a closure over single or multiple electrical outlets of the type having at least one electrical socket for insertion of prongs of the electrical plug, since the release lever extends over the prong-receiving socket portion of the outlet so as to prevent direct contact between the release means and the socket when inserted into the opening into the cap. Moreover, the opening in the cap is most desirably formed so as to require a release means or tool of a special configuration not readily accessible to a child and make it extremely difficult for a child to accidentally open.

The above and other objects, advantages and features of the present invention will become more readily appreciated and understood from the following description when taken together with the accompanying drawings in which:

DESCRIPTION OF FIGURES

FIG. 1 is a perspective view of one form of protective cover in assembled relation to an electrical outlet of the duplex type in accordance with the present invention.

FIG. 2 is a front view of the form of protective cover shown in FIG. 1.

FIG. 3 is a side view taken about lines 3—3 of FIG. 2.

FIG. 4 is a cross-sectional view taken about lines 4—4 of FIG. 2;

FIG. 5 is a front view of a modified form of the present invention; and

FIG. 6 is a cross-sectional view taken about lines 6—6 of FIG. 5.

DESCRIPTION OF PREFERRED AND ALTERNATE EMBODIMENTS

The protective cover of the present invention is readily conformable for use with various installations and especially floor or wall-mounted installations wherein it is desirable to position a protective covering over a member on the floor or wall either to prevent tampering or exposure to the elements. Again, the present invention is best typified by its use as a protective covering for electrical outlets or receptacles for plugs. For the purpose of illustration but not limitation, there is shown in FIGS. 1 to 4 a standard duplex receptable R having a pair of electrical plug-receiving outlets in connected relation to one another and which in a conventional manner, not shown, are customarily provided with connecting plates at opposite ends. The receptacle R is mounted in an electrical box of rectangular configuration which is positioned in a recess in a wall, baseboard or floor with terminals on the receptacle connected to the main wiring. Each outlet has prong-receiving recesses for insertion of the prongs P of an electrical plug so as to establish direct electrical contact with the wiring.

In accordance with the present invention, a protective cover assembly 10 includes a cover plate 12 of generally rectangular configuration corresponding to the configuration of the electrical box or other housing for the receptacle R. The cover plate 12 includes an upper flat surface 14 with sloped sides 15 and ends 16 as illustrated around the peripheral edges of the flat surface so that, when mounted in place over the receptacle, the sides 15 and ends 16 bear against the surrounding wall surface with the flat surface 14 slightly raised or protruding from the wall surface. When used with a duplex receptacle, the cover plate is provided with a pair of openings 18 in the flat surface 14 which are separated by a center partition strip 20. A hole 21 in the strip 20 is alignable with a threaded hole in the receptacle R in order to receive a screw 24 so as to affix the cover plate over the receptacle. The openings 18 are sized to be just slightly larger than the outlets of the receptacle R which are slightly raised or protruding from the wall surface.

In order to releasably cover the opening 18, a protective cap member 30 is provided in association with each opening 18, each cap member 30 being oversized with respect to an associated opening 18. Each cap member 30 is correspondingly of generally rectangular configuration having a flat outer peripheral edge 32 and a raised, generally convex portion 34 provided with a pair of slots 36 located adjacent to the free end of the cap opposite to hinged end 38. Preferably, the hinged end 38 is defined by a living hinge or membrane formed out of the material composition of the cover plate but of lesser thickness so as to possess added flexibility. As best seen from FIG. 4, a lever release arm or plate 40 inclines toward the interior of the raised portion 34 of the cap away from a latch member 42, the latter being in the form of a slight projection or lip protruding horizontally from the edge of the free end of the cap 30. The lip 42 is movable into alignment with the catch 44 which projects upwardly and is inclined toward the center opening 18. Preferably the lever arm 40 is of generally rectangular configuration and is sized to extend beneath the slots 36. In the closed position, the lever arm 40 rests upon an arcuate ridge 46 which extends upwardly a slight distance above the flat surface 12 of the cover plate adjacent to the opening 18. In this manner, when the lever arm 40 is pressed downwardly against the ridge 46, it will impart an upward lifting motion to the lip 42 sufficient to force the lip upwardly away from snap-fitting engagement with the catch 44.

In the form of invention described in FIGS. 1 to 4, most desirably the cover plate 12 and cap members 30 are composed of a plastic material with the living hinge 38 molded between the cap member and cover plate to form a unitary construction. In this relation, if desired, the protective cover plate may be formed of a transparent material and affixed over the existing cover plate for the electrical outlet so as not to necessitate removal of the cover plate or require painting of the cover plate assembly 10 to blend in with the existing decor. For this purpose, the transparent cover plate need not include the outer surrounding edges 15 and 16 but can merely consist of a flat surface portion which would be superimposed on the flat surface portion of the existing cover plate surrounding the outlet or receptacle R. In either form, the protective cap members can be individually or simultaneously advanced into the closed position by forcing the lips to move into snap-fit engagement with their respective catches 44. In order to release each cap member as a preliminary to swinging or hinging outwardly to the open position, for example, as illustrated by the lower cap member in FIG. 1, a tool or pointed element must be inserted through one or both of the slots 36 and forced downwardly to bear against the lever arm 40 thereby causing it to release the lip 42 from engagement with the catch member. The pronged end of the standard electrical plug is an ideal tool to employ for the purpose of releasing the cap without need for a special or separate tool. The lever plate 40 not only serves the function of releasing the latch or lip portion 42 from engagement with the catch 44, but also prevents accidental engagement between the tool and the prong-receiving slots of the outlet. This serves as added protection against one accidentally inserting a hair pin or other sharp metal object through one of the slots into engagement with the outlet.

In the modified form shown in FIG. 5, like parts are correspondingly enumerated to those of FIGS. 1 to 4. In the modified form, the protective cap members 30 are hinged and releasably latched into the closed position in the same manner as described with reference to FIGS. 1 to 4. However the cover plate surface 12 is provided with a ridge 50 which extends substantially around the entire peripheral extent of the opening 18 except for a slight interruption at the hinge section 38 and the opposite catch 44. The flattened peripheral edge 32 of each cap will, as in the form of FIGS. 1 to 4, move into flush engagement with the flat surface 12 with the outer protective ridge 50 in closely surrounding relation to the edge 32. The ridge not only serves as an effective weather barrier in the closed position, but also to minimize any danger of accidentally inserting a sharp object betweeen the cap 30 and plate surface 12 to pry the cap away from the outlet.

It is therefore to be understood that while preferred and alternate forms of the present invention have been herein set forth and described, various modifications and changes may be made in the construction and arrangement of parts thereof without departing from the spirit of the present invention as defined by the attached claims.

I claim:

1. A protective cover for electrical receptacles of the type having at least one electrical outlet for insertion of the prongs of an electrical plug, said cover comprising:

an adapter plate including an exterior surface, an interior surface with an opening in said plate alignable over said outlet, and means for releasably connecting said adapter plate to said receptacle such that the opening therein is aligned with said outlet for exposing same;

a catch member on the exterior surface of said plate alongside each opening;

a generally convex cap member including means securing said cap member to said plate on one side of each opening opposite to said catch member for movement between an open position and a closed position, said cap member sized to substantially cover the opening when in the closed position and having latching means movable into releasable engagement with said catch member when said cap member is in the closed position; and release means extending from one end of said cap and member adjacent to said latching means across the interior of said cap and beneath an opening in said cap member, and a tool insertable through an opening in said cap member to depress said release means in a direction to exert an upward pressure on said latching means to release said latching means from engagement with said catch member.

2. A protective cover according to claim 1, said opening in said cap member defined by a pair of slots sized for insertion of the prongs of an electrical plug therethrough, said securing means defined by a hinge.

3. A protective cover according to claim 1, said release means being formed of a lever arm at one side of the interior surface of said cap member for extension across said outlet when said cap member is in the closed position.

4. A protective cover according to claim 3, said latching means defined by a ridge forming a coplanar extention of said lever in a direction toward said catch member and movable into snap-fit engagement with said catch member.

5. A protective cover according to claim 1, said latching means including a resilient ridge movable into snap-fit engagement with said catch member.

6. A protective cover according to claim 1, said latching means and said catch member each defined by a resilient ridge, said catch member spaced above the exterior surface of said plate.

7. A protective cover according to claim 1, said plate including a raised border extending around the periphery of each opening and each cap member having an outer peripheral edge movable into close fitting engagement with said border.

8. A protective cover for an electrical outlet of the type having at least one electrical socket for insertion of the prongs of an electrical plug, said cover comprising:

a cover plate including an exterior surface, an interior surface with an opening in said plate alignable over each said socket, and fastener means for releasably connecting said cover plate to said outlet such that the opening therein is aligned with said socket for exposing same;

an upstanding catch member on the exterior surface of said plate alongside each opening;

a generally convex cap member including means hinging said cap member to said plate on one side of each opening opposite to said catch member for movement between an open position and a closed position, said cap member sized to substantially cover the opening when in the closed position and having a complementary latching member engageable with said catch member when said cap member is in the closed position; and a lever arm extending from one end of said cap member adjacent to said complementary latching member across the interior of said cap member and beneath slots in said cap member, and the prongs of an electrical plug being insertable through the slots in said cap member to depress said lever arm in a direction to exert an upward pressure on said complementary latching member to release said complementary latching member from engagement with said catch member.

9. A protective cover according to claim 8, said lever arm disposed at one side of the interior surface of said cap member for extension across said socket when said cap member is in the closed position, and a ledge extending upwardly from mid plate to bear against the underside of mid lever arm when said cap member is in the closed position.

10. A protective cover according to claim 9, said complementary latching member including a ridge defining a coplanar extension of said lever arm in a direction toward said catch member, said ridge movable into snap-fit engagement with said catch member.

11. A protective cover according to claim 8, said complementary latching member and said catch member each defined by a resilient ridge, said catch member extending beyond exterior surface of said cover plate.

12. A protective cover according to claim 8, said cover plate including a raised border extending around the periphery of each opening and each cap member having an outer peripheral edge movable into close fitting engagement with said border.

* * * * *